United States Patent [19]

Yamaguchi et al.

[11] Patent Number: 4,950,573

[45] Date of Patent: Aug. 21, 1990

[54] TONER FOR DEVELOPING LATENT ELECTROSTATIC IMAGES

[75] Inventors: Kimitoshi Yamaguchi; Kazuhiko Umemura; Yoshihiro Nomura, all of Numazu, Japan

[73] Assignee: Ricoh Company, Ltd., Tokyo, Japan

[21] Appl. No.: 121,483

[22] Filed: Nov. 17, 1987

[30] Foreign Application Priority Data

Nov. 20, 1986 [JP] Japan ..... 61-278069

[51] Int. Cl.[5] ..... G03G 9/10

[52] U.S. Cl. ..... 430/109; 430/111

[58] Field of Search ..... 430/109, 111, 122

[56] References Cited

U.S. PATENT DOCUMENTS

| | | | |
|---|---|---|---|
| 3,944,493 | 3/1976 | Jadwin et al. | 430/109 |
| 4,254,201 | 3/1981 | Sawai et al. | 430/109 |
| 4,254,203 | 3/1981 | Oka et al. | 430/122 |
| 4,254,204 | 3/1981 | Kato et al. | 430/111 |
| 4,329,415 | 5/1982 | Ikeda et al. | 430/111 |
| 4,395,485 | 7/1983 | Kashiwagi et al. | 430/109 |

*Primary Examiner*—John L. Goodrow

*Attorney, Agent, or Firm*—Flynn, Thiel, Boutell & Tanis

[57] ABSTRACT

A toner for developing latent electrostatic images is disclosed, which comprises (a) thermofusible base particles A having a softening point of 80° C. or less, a flow starting temperature of 110° C. or less, and an average particle size of 5 to 25 μm, and (b) small particles B comprising as the main component an organic polymeric material having a softening point at least 5° C. higher than the softening point of the base particles A and no practical softening point, and an average particle size ranging from 0.1 μm or more, but not more than ¼ of the average particle size of the base particles A, which small particles B are embedded in the surface of the base particles A so as to cover the surface of the base particles A to a depth of less than the particle size of the small particles B.

5 Claims, 1 Drawing Sheet

TONER FOR DEVELOPING LATENT ELECTROSTATIC IMAGES

BACKGROUND OF THE INVENTION

The present invention relates to a toner for developing latent electrostatic images comprising large heat-fixing base particles in the surface of which small organic polymer particles are embedded.

As is generally known, a toner for developing latent electrostatic images formed on an electrophotographic photoconductor, electrostatic recording medium and the like essentially comprises a thermoplastic resin such as styrene resin and acrylic resin, with the further addition of pigments and magnetic powder if necessary. Generally in a dry-type development method, a toner having an average particle size of 5 to 25 μm, with a low softening point, is used because of good image fixing capability, particularly at low temperatures. However, such kinds of toner particles with a low softening point are susceptible to mutual aggregation, or so-called blocking in their preservation or use, particularly in a high temperature atmosphere.

With the objective of eliminating such shortcomings, a toner composed of a blend of large particles with a low softening point and small particles with a high softening point has been proposed. However, in the case of this blend-type toner, shortcomings are indicated as follows:

(1) A sufficient blocking resistance is not maintained because of the easy contact of the large toner particles with one another, particularly when the amount of small particles is small compared with that of the large particles.

(2) The large particles are crushed to form small particles by contact with the carrier in the copying process thus forming a spent toner and consequently, low durability and degrading performance of the toner due to the film forming (so-called filming) on the photoconductor and on a carrier, if any, occur.

(3) A trend by which large toner particles are consumed in preference to the small toner particles during the copying process induces a change of the toner composition from the initial developing condition, reducing the quality of the images and the fixing properties.

SUMMARY OF THE INVENTION

It is therefore an object of the present invention to provide a toner for developing latent electrostatic images with excellent low temperature fixing capability, improved blocking resistance and durability, no adverse effect on the photoconductor and carrier, and no change of the composition in the copying process, which consequently does not reduce the quality of the images and the image fixing capability.

The toner for developing latent electrostatic images according to the present invention comprises heat fixing base particles A having a softening point of 80° C. or less, a flow starting temperature of 110° C. or less, and an average particle size of 5 to 25 μm, in the surface of which small particles B, comprising an organic polymeric material having a softening point at least 5° C. higher than that of the base particles A or no practical softening point and an average particle size of 0.1 μm or more, but no more than ¼ of that of the base particles A, are embedded to a depth of less than the particle size of the small particles B, covering the surface of the base particles A, as shown in FIG. 1.

Herein, the softening point represents a temperature at which an uniformly transparent body or phase is observed when a sample toner having a volume of 1 cu.cm placed in a cylinder is compressed and extruded through a nozzle of 0.5 mm diameter and 1 mm length, by a "Kohka type" flow tester (made by Shimadzu Mfg. Co.) under a loading of 10 kg/sq.cm and application of heat with an increasing temperature rate of 3° C./min, eventually evacuating the air space within the cylinder by a gradual lowering of a plunger. Also, the flow starting temperature represents a temperature at which the plunger resumes the lowering motion after a temporary halt in the foregoing conditions.

DETAILED DESCRIPTION OF THE PREFERRED EMBODIMENT

Figure 1:
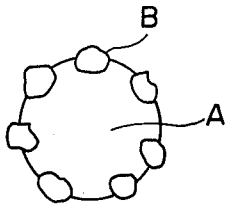
FIG. 1 is a schematic cross-sectional view of a toner according to the present invention.

According to the present invention, the base particle A comprises as the main component a thermofusible resin or a wax, with the further addition of a pigment and/or a magnetic material if necessary, and is used for low temperature fixing and coloring. On the other hand, the small particle B comprises as the main component an organic polymeric material, with the further addition of a pigment and/or a magnetic material if necessary, as in the case of the base particle A. The small particle B is mainly used for improving blocking resistance, preventing the filming of the toner on the photoconductor and on the carrier, and maintaining suitable chargeability of the toner.

Herein, it is preferable that the base particle A have a softening point of 80° C. or less for good image fixing with the coverage ratio of the base particle A with the small particles B maintained high, a flow starting temperature of 110° C. or less for sufficient embedding of the small particles B in the base particle A and for good image fixing, and an average particle size of 5 to 25 μm for less spent phenomenon and good resolution.

On the other hand, it is preferable that the small particles B have a softening point at least 5° C. higher than that of the base particles A (or no practical softening point) and an average particle size of 0.1 μm or more, but not more than ¼ of the average particle size of the base particles A, in order to secure excellent heat resistance and no filming of the toner on the photoconductor and a carrier, if any, and easy production of the toner by avoiding the aggregation of the toner particles.

Furthermore, according to the present invention, in order to maintain good low temperature image fixing capability as well as sufficient blocking capability, the coverage area ratio of the small particles, defined as the ratio of the area of the small particles thereof projected onto the surface of the base particle, preferably ranges from 40 to 100% of the surface area of the base particle.

The coverage area ratio $\alpha$ (x 100%) of the small particles B is obtained as follows. Since the surface area of a base particle A is expressed by $$4\pi\left(\frac{kd}{2}\right)^2,$$

and the area projected onto the base particle A by one small particle B is expressed by $$\pi\left(\frac{d}{2}\right)^2,$$

when the diameter of the base particle A is kd, and the diameter of the small particle B is d.

When the base particle A is covered by n small particles B, the coverage area ratio $\alpha$ of the small particles is $$\alpha = \frac{n\pi\left(\frac{d}{2}\right)^2}{4\pi\left(\frac{kd}{2}\right)^2} = \frac{n}{4k^2}$$

When the true specific gravity of the small particles B is $\rho s$, the true specific gravity of the base particles A is $\rho b$, the weight of one base particle A is Wb, and the weight of n small particles B per one base particle A is Ws, $$\frac{Ws}{Wb} = \frac{n \cdot \frac{4}{3}\pi\left(\frac{d}{2}\right)^3 \rho s}{\frac{4}{3}\pi\left(\frac{kd}{2}\right)^3 \rho b} = \frac{n}{k^3} \cdot \frac{\rho s}{\rho b} \quad (2)$$

By substituting Eq. (1) into Eq. (2), $$\alpha = \frac{Ws}{Wb} \cdot \frac{\rho b}{\rho s} \cdot \frac{k}{4} \quad (3)$$

is obtained.

When the particle size ratio k, and the true specific gravity ratio $\rho b/\rho s$ of the base particle A to the small particle B are known, it was found that an appropriate coverage area ratio $\alpha$ (x 100%) ranges from 40 to 100%. This can be found by changing Ws/Wb.

A toner according to the present invention is prepared by heating the base particles at a temperature close to the softening point thereof to soften, adding small particles and stirring to mix. According to the procedure, the toner according to the present invention is obtained in a state wherein the small particles are embedded in the surface of the base particles, whereby the embedding depth is adjusted to less than the average particle size of the small particles by controlling the stirring condition and heating temperature, to obtain excellent image fixing capability.

The materials for the base particles are, for example, styrene resins (homopolymers or copolymers of styrene or substituted styrene) such as polystyrene, polychlorostyrene, poly-$\alpha$-methylstyrene, styrene-chlorostyrene copolymer, styrene-propylene copolymer, styrene-butadiene copolymer, styrene-vinyl-chloride copolymer, styrene-vinylacetate copolymer, styrene-maleic acid copolymer, styrene-acrylate copolymer (such as styrene-methyl acrylate copolymer, styrene-ethyl acrylate copolymer, styrene-butyl acrylate copolymer, styrene-octyl acrylate copolymer, styrene-phenyl acrylate copolymer), styrene mathacrylate copolymer (such as styrene-methyl methacrylate copolymer, styrene-ethyl methacrylate copolymer, styrene-butyl methacrylate copolymer, styrene phenyl methacrylate copolymer), styrene-$\alpha$-chloromethyl acrylate copolymer and styrene-acrylonitrile-acrylate copolymer; thermofusible resins such as vinylchloride resin, styrene-vinylacetate copolymer, rosin-modified maleic acid resin, epoxy resin, polyester resin, polyethylene, polypropylene, ionomer resin, polyurethane resin, ketone resin, ethylene-ethyl acrylate copolymer, xylene resin and polyvinylbutyral; and waxes such as natural waxes and synthetic waxes. These materials can be used alone or in combination.

Organic polymeric materials for the small particles B can be selected from the materials for above-mentioned base particles, depending on the softening point of the base particles. Also, resins which are inappropriate as the materials for the base particles having a high softening point or no practical softening point, for example, silicone resin and benzoguanamine-formaldehyde condensates, can be employed as the materials for the small particles.

As the colorants, carbon black, chrome-containing monoazo dye, nigrosine dye, aniline blue, Calconyl Blue, Chrome Yellow, ultramarine blue, Quinoline Yellow, Methylene Blue chloride, Monastral Blue, Malachite Green Oxalate, lamp black, Rose bengale, Monastral Red, Sudan Black BM and their mixtures can be employed. As the magnetic materials, Co, Fe, Ni metal powders; Al, Co, Cu, Fe, Pb, Ni, Mg, Sn, Zn, Au, Ag, Se, Ti, W, Zr metal alloys or their mixtures; Fe and Ni metal oxides or metal compounds containing these materials; ferromagnetic ferrite, and the mixtures thereof can be employed.

Furthermore, in order to improve the fluidity of the toner according to the present invention, fine powders of silica, alumina and titanium oxide can be added and mixed.

The toner according to the present invention prepared by the foregoing procedure is used as an one-component dry-type developer which contains a magnetic material inside the base particle and/or the small particle, or as a two-component dry-type developer in which a magnetic material is mixed with the toner.

The present invention will now be explained in detail with reference to the following examples, in which the term "part(s)" is expressed on a weight basis. In the following examples, the blocking resistance and image fixing performance in the examples were evaluated in the following respective procedures:

Blocking resistance (determined by mm):

10 g of each sample toner is placed in a glass bottle with an inner diameter of a 25 mm and a length of 70 mm. The glass bottle is then allowed to stand in a thermostatic chamber at 55° C. for 24 hours. The penetration of the sample toner is then measured by a penetrameter in accordance with the Japanese Industrial Standards, JIS-K2630.

Image fixing capability (determined by the image fixing lower limit temperature (° C.)):

A sample toner is fixed on a sheet of copy paper by use of a Teflon-coated image fixing roller, under the conditions that the nip width and the line speed thereof are respectively set at 6 mm and at 120 mm/sec, with the temperature of the image fixing roller changed. When the image fixing ratio of the toner to the copy paper, measured by a clockmeter, reaches 70%, the image fixing temperature at that moment is measured and the image fixing capability is determined by the temperature.

EXAMPLE 1

A mixture of 90 parts of polyester resin and 10 parts of carbon black was kneaded, ground and classified to produce base particles with an average particle size of 17 μm. The softening point of the base particles measured by use of a "Kohka-type" flow tester was 68° C., and the flow starting temperature by the same tester was 96° C.

Further, a mixture of 90 parts of styrene - n-butyl methacrylate copolymer, 10 parts of carbon black and 3 parts of a chrome-containing monoazo dye was kneaded, ground and classified to produce small particles with an average particle size of 3.5 μm. The softening point of the small particles was 85° C. and the flow starting temperature was 130° C.

The small particles and the base particles were then mixed in a weight ratio of 0.49/1.0, and the mixture was stirred in a V-shape blender in an atmosphere of 72° C. for 1 hour, whereby a toner No. 1 according to the present invention was prepared.

The coverage area ratio of the small particles in this toner was about 60%, assuming $\rho b/\rho s \div 1.0$. The blocking resistance was as good as 23 mm. It was observed by scanning electron microscopy that the small particles were partially embedded in the surface of the base particles of this toner.

Then, the image fixing capability (i.e. the image fixing lower limit temperature) of a two-component dry-type developer, which was prepared by adding and mixing 3 parts of the above-mentioned toner and 100 parts of a carrier comprising ferrite powder with an average particle size of 100 μm coated with polymethyl methacrylate with a thickness of 1 μm, was investigated. Good low temperature image fixing capability at 110° C. was indicated, whereby sufficient contact of the base particles with copy papers was attained. This was because the small particles were thrust into the softened base particles during the image fixing process.

Using the above-mentioned developer, with the initial charge quantity of the toner being −18 μC/g, a copying process, making 100,000 copies, was carried out by use of a commercially available plain paper copier (Trademark "FT-4060" made by Ricoh Co., Ltd.). After the copying process, the electrostatic charge quantity of the toner was −16 μC/g, which was almost the same as the initial charge quantity of the toner, thus the initial high image quality was preserved. Also, no separation of the small particles from the base particles was observed and the image fixing lower limit temperature was stable at 110° C. No filming of the toner was observed on the surface of the photoconductor drum.

EXAMPLE 2

A mixture of 90 parts of styrene - n-butyl methacrylate copolymer and 10 parts of carbon black was kneaded, ground and classified to prepare base particles with an average particle size of 17 μm. The softening point of the base particles was 64° C. and the flow starting temperature thereof 90° C. as measured by use of the same flow tester as that employed in Example 1.

Then the small particles prepared in Example 1 and above-mentioned base particles were mixed in a weight ratio of 0.58/1.00, and the mixture was stirred in a V-shape blender in an atmosphere of 70° C. for 1 hour, whereby a toner No. 2 according to the present invention was prepared.

The coverage area ratio of the small particles in this toner was about 70%, assuming $\rho b/\rho s \div 1$. The blocking resistance was as good as 27 mm. It was observed by scanning electron microscopy that the small particles were partially embedded in the surface of the base particles of this toner.

Then, using this toner, a developer was prepared by the same procedure as in Example 1, for the same image fixing test as in Example 1. The image fixing lower limit temperature was 115° C., indicating good low temperature fixing capability. Using this developer, with the initial charge quantity of the toner being −20 μC/g, a copying process, making 100,000 copies, was carried out as in Example 1. The charge quantity of the toner was −19 μC/g, which was almost the same as the initial charge quantity thereof, and the high image quality was preserved.

After making 100,000 copies, the image fixing lower limit temperature was stable at 115° C. and no filming of the toner was observed on the photoconductor drum.

EXAMPLE 3

A mixture of 90 parts of styrene - n-butyl methacrylate copolymer, 10 parts of carbon black and 2 parts of Nigrosine dye was processed in the same manner as in Example 1, so that small particles with an average particle size of 4 μm were prepared. The softening point of the small particles was 86° C. and the flow starting temperature thereof was 131° C. as measured by the same flow tester as that employed in Example 1.

The above small particles and the base particles prepared in Example 2 were mixed in a weight ratio of 0.66/1.00 and the mixture was processed in the same manner as in Example 2, so that a toner No. 3 according to the present invention was prepared.

The coverage area ratio of the small particles in this toner was about 70%, assuming $\rho b/\rho s \div 1$. The blocking resistance was as good as 25 mm.

Then, using this toner, a developer was prepared by the same procedure as in Example 1, for the same image fixing test as in Example 1. The image fixing lower limit temperature of the toner was 115° C., indicating good low temperature fixing capability.

Using this developer, with the initial charge quantity of the toner being +25 μC/g, a copying process, making 100,000 copies, was carried out by use of the same plain paper copier as that employed in Example 1. After the copying process, the charge quantity of the toner was +27 μC/g, which was almost the same as the initial charge quantity of the toner, and the initial high image quality was preserved. Also the fixing temperature of the toner was stable at 115° C. and no filming of the toner was observed on the photoconductor drum.

EXAMPLE 4

A mixture of 90 parts of polyester resin, 10 parts of carbon black, and 50 parts of tri-iron tetroxide having an average particle size of 0.2 μm (Trademark "FPT 1000" made by Toda Kogyo Co., Ltd.) serving as a magnetic material, was kneaded, ground and classified to prepare base particles with an average particle size of 17 μm. The softening point of the base particles was 71° C. and the flow starting temperature thereof was 98° C. as measured by use of the same flow tester as that employed in Example 1.

In addition, a mixture of 90 parts of styrene - n-butyl methacrylate copolymer, 10 parts of carbon black and 3 parts of Nigrosine dye was kneaded, ground and classified to prepare small particles with an average size of 3.5 μm. The softening point of the small particles was 87° C. and the flow starting temperature thereof was 132° C. as measured by use of the flow tester.

Then, the small particles and the base particles were mixed in a weight ratio of 0.49/1.00, and the mixture was then stirred in a V-shape blender in an atmosphere of 71° C. for 1 hour, whereby a toner No. 4 according to the present invention was prepared.

The magnetic toner prepared in this manner (one-component dry-type developer) showed an 80% coverage area ratio of the small particles, assuming $\rho b/\rho s \div 1.33$. The blocking resistance of this toner was as good as 28 mm.

Latent electrostatic image samples were developed with this toner, but unfixed, by use of a commercial available plain paper copying machine (Trademark "M-10" made by Ricoh Co., Ltd.), and an image fixing test was carried out using a standard image fixing device. The image fixing lower limit temperature was as good as 115° C. After making 20,000 copies by this copying machine, images with as high quality as the initial ones were obtained. The image fixing lower limit temperature was stable at 115° C., and no filming of the toner was observed on the photoconductor drum.

Comparative Example

A blend-type, comparative toner was prepared by the same procedure as in Example 1 except that the base particles and the small particles were simply mixed.

The blocking resistance of this comparative toner was as poor as 4 mm. A structure quite different from the toner according to the present invention was observed by scanning electron microscopy inasmuch as the small particles were mostly separated from one another, and not embedded in the surface of the base particles.

This blend-type toner was then mixed with the same carrier as that employed in Example 1 by the same procedure as in Example 1, so that a two-component type developer was prepared. The image fixing capability as determined by the image fixing lower limit temperature was found to be as good as 110° C. However, the state of this toner as observed by scanning electron microscopy indicated that the base particles were predominantly used for the development and consumed, but only a small amount of the small particles was used for the development.

Then, using this developer, with the initial charge quantity of the toner being −12 μC/g, a copying process, making 100,000 copies, by use of a commercial plain paper copier (Ricoh FT4060), was carried out. After the copying process, the charge quantity of the toner changed to −5 μC/g and, therefore, a sharp reduction of the initial high image quality occurred. Also, a very high degree of spent toner formation occurred through crushing of the base particles, and the surface of the carrier was covered by the spent toner. The filming of the base particles on the photoconductor drum was observed

EXAMPLE 5

Spherical small particles (with no practical softening temperature of methyl polysiloxane with an average particle size of 2 μm, having a formula, $\text{-}[CH_3SiO_{1.5}]_n$, were mixed with a carrier comprising ferrite powder with an average particle size of 100 μm, coated with methyl methacrylate resin with a thickness of 1 μm in a weight ratio of 0.3% to the carrier, and the mixture was stirred in a ball mill pot for 30 minutes. The charge quantity of the resulting small particles measured by the blow-off method was −140 μC/g, indicating good chargeability.

A mixture of 90 parts of polyester resin and 10 parts of carbon black was kneaded, ground and classified to prepare base particles with an average particle size of 15 μm. The softening point of the base particles was 62° C. and the flow starting temperature thereof was 78° C. as measured by use of the flow tester.

Figure 2:
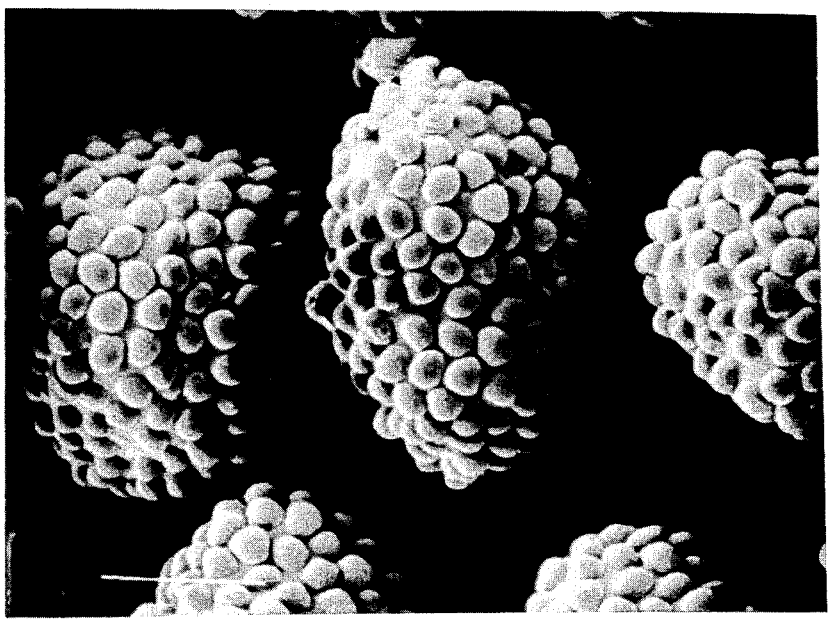
FIG. 2 is a microscopic photograph of the toner particles according to the present invention.

Then, after stirring the small particles and the base particles in a weight ratio of 1/2.7 by a mixer, 100 g of the thus obtained mixture was further stirred in an atmosphere of 62° C. for 1 hour, whereby a toner No. 5 according to the present invention was prepared. The coverage area ratio of the small particles of the thus prepared toner was about 64%, assuming $\rho s \div 1.30$ g/cu.cm and $\rho b = 1.20$ g/cu.cm. The particle structure of this toner observed by scanning electron microscopy is shown in FIG. 2. The blocking resistance of this toner was 28 mm.

The toner was then mixed with a carrier comprising ferrite powder with an average particle size of 100 μm coated with polymethyl acrylate with a thickness of 1 μm, in an amount of 3.5 wt % to the carrier, to prepare a developer. An image fixing test showed that the image fixing lower limit temperature of the toner was 110° C., indicating the feasibility of low temperature image fixing.

Using this developer, with the initial charge quantity of the toner being −22 μC/g, a copying process, making 100,000 copies, by use of a commercial plain paper copier (Trademark "Ricoh FT6080" made by Ricoh Co., Ltd.), was carried out. After the copying process, the charge quantity of the toner was −20 μC/g, which was almost same as the initial charge quantity of the toner, thus, the initial high image quality was maintained. Also, the image fixing lower limit temperature of this toner was stable at 110° C. in the standard fixing conditions, and no filming of the toner was observed on the photoconductor drum.

On the other hand, in the case where only the base particles were used as a comparative toner sample, a blocking resistance of 0.3 mm, an image fixing lower limit temperature of 105° C., and a toner charge quantity −10 μC/g (when used in a developer) were obtained. After a copying process, making 100,000 copies, the image fixing lower limit temperature was 105° C., the charge quantity of the toner was −5 μC/g and the filming of the toner on the photoconductor drum and deposition of the toner on the background of the obtained images occurred

EXAMPLE 6

Spherical fine powder of methyl polysiloxane with an average particle size of 0.3 μm, having the same structural formula as that employed in Example 5, was mixed with the same carrier as that employed in Example 5 in an amount 0.1 wt % to the carrier, and the mixture was stirred in a ball mill pot for 30 minutes, whereby small particles were obtained. The charge quantity of the thus obtained small particles measured by the blow-off method was −210 μC/g, indicating good chargeability.

Then, after stirring the small particles and the base particles in a weight ratio of 1/14 using a mixer, 100 g of the thus obtained mixture was further stirred in an atmosphere of 62° C. for 1 hour, whereby a toner No. 6 according to the present invention was prepared.

The coverage area ratio of the small particles of the thus prepared toner was about 82%, assuming ρs=1.30 g/cu.cm and ρb=1.20 g/cu.cm. The blocking resistance of the toner was 26 mm.

The toner was then mixed with a carrier comprising ferrite powder with an average particle size of 100 μm coated with a polymethyl methacrylate with a thickness of about 1 μm, in an amount of 3.5 wt % to the carrier, to prepare a developer. An image fixing test showed that the image fixing lower limit temperature of the developer was 110° C., indicating the feasibility of low temperature image fixing.

Using this developer, with the charge initial charge quantity of the toner being −20 μC/g, a copying process, making 100,000 copies, by use of a commercial plain paper copier (Ricoh FT6080), was carried out. After the copying process, the charge quantity of the toner was −19 μC/g, which was almost the same as the initial charge quantity of the toner, thus, the initial high image quality was maintained. Also, the image fixing lower limit temperature of this toner was stable at 110° C. in the standard fixing conditions, and no filming of the toner was observed on the photoconductor drum.

EXAMPLE 7

Finely-divided particles (no softening point, decomposition at 300° C.) of benzoguanamine-formaldehyde condensate with an average particle size of 1.3 μm, having the following structural formula,

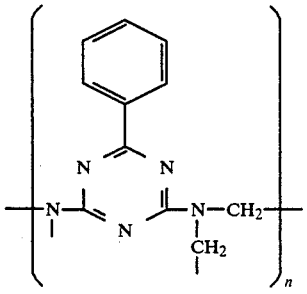

were mixed with a carrier comprising ferrite powder with an average particle size of 100 μm coated with silicone resin in with a thickness of about 1 μm, in an amount of 0.2 wt % to the carrier, and the mixture was stirred for 30 minutes in a ball mill pot, whereby small particles were prepared. The charge quantity of the thus prepared small particles measured by the blow-off method was as good as +160 μC/g.

After mixing the small particles and the base particles employed in Example 5 in a weight ratio of 1/5, the mixture was stirred by a mixer, then 100 g of the resulting mixture was further stirred in an atmosphere of 62° C. for 1 hour, whereby a toner No. 7 according to the present invention was prepared.

The coverage area ratio of the small particles in this toner was about 64%, assuming ρs=1.35 g/cu.cm and ρb=1.20 g/cu.cm. The blocking resistance of this toner was 27 mm.

The toner was then mixed with a carrier comprising ferrite powder with an average particle size of 100 μm coated by silicone resin with a thickness of about 1 μm, in an amount of 3.5 wt % to the carrier, to prepare a developer. An image fixing test showed that the image fixing lower limit temperature of the toner was 110° C., indicating the feasibility of low temperature image fixing.

Using this developer, with the initial charge quantity of the toner being +20 μC/g, a copying process, making 100,000 copies, was carried out by use of a commercial plain paper copier (Trademark "Ricoh FT7500" made by Ricoh Co., Ltd.). After the copying process, the charge quantity of the toner was +21 μC/g, which was almost the same as the initial charge quantity of the toner, thus the initial high image quality was maintained. Also, the image fixing lower limit temperature was stable at 110° C. in the standard image fixing conditions, and no filming of the toner was observed on the photoconductor drum.

EXAMPLE 8

Finely-divided particles of benzoguanamine-formaldehyde condensate (no softening point, decomposition at 300° C.) with an average particle size of 0.2 μm, having the same structural formula as in Example 7, were mixed with the same carrier as that employed in Example 7, in an amount of 0.1 wt % to the carrier, and the mixture was stirred in a ball mill pot for 30 minutes, whereby small particles were prepared. The charge quantity of the thus prepared small particles measured by the blow-off method was +220 μC/g, indicating good chargeability.

Then, after the above small particles and the base particles employed Example 5 were mixed with a weight ratio 1/25, the mixture was stirred by a mixer, then 100 g of the resultings mixture was further stirred for 1 hour in an atmosphere of 60° C., whereby a toner No. 8 according to the present invention was prepared.

The coverage area ratio of the small particles in this toner was about 84%, assuming ρs=1.35 g/cu.cm and ρb=1.20 g/cu.cm. The blocking resistance of this toner was 25 mm.

This toner was mixed with a carrier comprising ferrite powder with an the average particle size of 100 μ coated with silicone resin with a thickness of about 1 μm, in an amount of 3.5 wt % to the carrier, to prepare a developer. An image fixing test showed that the image fixing lower limit image fixing temperature was 110° C., indicating the feasibility of low temperature image fixing.

Using this developer, with the initial charge quantity of the toner being +25 μC/g, a copying process, making 100,000 copies, was then carried out by use of a commercial plain paper copier (Trademark "Ricoh FT7500" made by Ricoh Co., Ltd.). After the copying process, the charge quantity of the toner was +24 μC/g, which was almost same as the initial, thus the initial image high quality was preserved. Also the image fixing lower temperature was stable at 110° C. in the standard fixing conditions and no filming of the toner was observed on the photoconductor drum.

Thus, according to the present invention, there can be provided a toner for developing latent electrostatic images with excellent low temperature image fixing capability, improved blocking resistance and durability, no adverse effects on the photoconductor and the carrier, and no change of the composition in the copying process, which consequently does not reduce the quality of the images and the image fixing capability.

What is claimed is:

1. A toner for developing latent electrostatic images comprising:

(a) thermofusible base particles A having a softening point of 80° C. or less, a flow starting temperature of 110° C. or less, and an average particle size of 5 to 25 μm, and (b) small particles B comprising as the main component an organic polymeric material having a softening point at least 5° C. higher than the softening point of said base particles A or no practical softening point, and an average particle size ranging from 0.1 μm or more, but not more than ¼ of the average particle size of said base particles A, which small particles B are embedded in the surface of said base particles A so as to cover the surface of said base particles A to a depth of less than the particle size of said small particles B, the coverage area ratio of said small particles B on the surface of said base particles A being in the range of 40–100% of the surface area of said base particles A, wherein softening point, flow starting temperature and coverage area ratio have the meanings defined in the specification.

2. The toner as claimed in claim 1 in which said thermofusible base particles are free of magnetic material.

3. The toner as claimed in claim 1, further comprising a colorant in said small particles B.

4. The toner as claimed in claim 1, further comprising a charge controlling agent in said small particles B.

5. A toner for developing latent electrostatic images, consisting of thermofusible base particles A having an average particle size of 5 to 25 μm and small particles B having an average particle size of from 0.1 μm up to ¼ of the average particle size of said base particles A, said small particles B being fixed in the surfaces of and being partially surrounded by the mass of said thermofusible base particles with the remainders of said small particles projecting outwardly from the surfaces of said thermofusible base particles, the coverage area ratio of said small particles B on the surface of said base particles A being in the range of 40–100% of the surface area of said base particles A, said thermofusible base particles A having a softening point of 80° C. or less and a flow starting temperature of b 110° C. or less, the main component of said small particles B being an organic polymeric material having no practical softening point or a softening point at least 5° C. higher than the softening point of said particles A, wherein softening point, flow starting temperature and coverage area ratio have the meanings defined in the specification.

* * * * *